US008132294B2

(12) United States Patent
Spreafico

(10) Patent No.: US 8,132,294 B2
(45) Date of Patent: Mar. 13, 2012

(54) SNAP HINGE FOR FURNITURE

(75) Inventor: Gianpiero Spreafico, Cisano Bergamasco (IT)

(73) Assignee: Spreafico Cerniere S.r.l., Calolziocorte (IT)

( * ) Notice: Subject to any disclaimer, the term of this patent is extended or adjusted under 35 U.S.C. 154(b) by 541 days.

(21) Appl. No.: 12/274,640

(22) Filed: Nov. 20, 2008

(65) Prior Publication Data

US 2009/0133218 A1 May 28, 2009

(30) Foreign Application Priority Data

Nov. 22, 2007 (IT) ..... MI2007A2213

(51) Int. Cl.
*E05D 15/32* (2006.01)

(52) U.S. Cl. ..... 16/370; 16/277; 16/304

(58) Field of Classification Search ..... 16/277, 16/281–283, 286–288, 304, 366
See application file for complete search history.

(56) References Cited

U.S. PATENT DOCUMENTS

| | | | | |
|---|---|---|---|---|
| 3,840,936 | A * | 10/1974 | Sato | 16/286 |
| 6,141,832 | A * | 11/2000 | Salice | 16/366 |
| 6,374,459 | B1 * | 4/2002 | Zetti | 16/366 |
| 6,568,035 | B2 * | 5/2003 | Zetti | 16/370 |
| 7,003,851 | B2 * | 2/2006 | Salice | 16/285 |
| 7,059,018 | B2 * | 6/2006 | Koshikawa et al. | 16/302 |
| 7,100,241 | B2 * | 9/2006 | Zetti | 16/304 |
| 7,574,775 | B2 * | 8/2009 | Zetti | 16/370 |
| 2008/0034540 | A1 * | 2/2008 | Avery et al. | 16/286 |

* cited by examiner

*Primary Examiner* — Victor Batson
*Assistant Examiner* — Roberta Delisle
(74) *Attorney, Agent, or Firm* — Oblon, Spivak, McClelland, Maier & Neustadt, L.L.P.

(57) ABSTRACT

Snap hinge (10) for furniture comprising two articulated quadrilaterals elastically driven by at least two elastic means wherein at least one of said elastic means consists of a double spiral flexure spring stressed perpendicularly to the winding axis of the double spiral.

3 Claims, 5 Drawing Sheets

SNAP HINGE FOR FURNITURE

The present invention refers to a snap hinge for furniture.

In particular the invention relates to a snap hinge for rotating and supporting a closing element of a cabinet. Snap hinges are known in the furnishing industry for imposing on furniture-closing elements an elastic forcing condition.

It is in fact known that in a closed position it is often desirable to maintain the closing element firmly in contact with the furniture.

It is also known that in an open position, in particular in the case of elements closing wall cabinets rotatingly upwards, the hinges have to exert a relatively great force to support the weight of the closing element and maintain the closing element raised.

These forces obtained by means of generally soft elastic elements are even greater in the case of closing elements for closing furniture for campers, caravans or the like inasmuch as the dynamic situation to which the closing element is subjected in both the closed or open positions requires greater force and resistance of the hinge and of the elastic elements.

Known snap hinges comprise a first and a second articulated quadrilateral that have in common a first and a second lever and which have as a base element respectively a first fixing bracket for fixing to a fixed element of a piece of furniture or the like and a second fixing bracket for fixing to a closing element.

Recent known prior-art snap hinges further comprise at least two springs arranged in a kinematic chain between the two articulated quadrilaterals.

Each of the two articulated quadrilaterals consists of the first and the second lever, of an arm and of a base element, respectively one of the fixing plates, which are articulated amongst one another. In particular, the hinge is made so that in the opening configuration the spring of the snap hinge operates in opposition to the weight force of the door and thus has a function of supporting the door.

In the closing configuration the elastic action exerted by the spring is suitable for maintaining the door in a closed position closing the space of the closing element.

A hinge according to the prior art is described in European patent application EP1741860.

The snap hinge according to EP1741860, made for supporting a closing element, comprises a first articulated quadrilateral and a second articulated quadrilateral that have in common a first lever and a second lever, and which have as a base element, respectively, a fixing plate for fixing to a fixed element and a fixing plate for fixing to a closing element, elastic means acting between a point of said first lever and a point of said second lever, the hinge has the special feature of providing auxiliary elastic means arrange serially on said elastic means having an end articulated on said first lever and the opposite end articulated on an abutting element associated integrally with said fixing plate.

The hinge according to EP1741860 thus requires an additional element—the abutting element—associated integrally with the fixing plate. On the aforesaid additional element there is rested the auxiliary spring, a helicoidal torsion spring inserted between telescopic capsules to exert the force between the articulated quadrilaterals.

The hinge according to the aforesaid prior art is thus complicated to make and assemble and is therefore relatively costly to produce.

The geometry of the levers constituting the two articulated quadrilaterals must also of necessity take into account the elastic force that the springs and in particular the auxiliary spring have to exert to provide the necessary support and seal.

The helicoidal springs thus have to provide sufficient development to be able to exert the required elastic forces.

In addition to the structural complexity of the hinge according to EP1741860, there must be added a non optimised elastic force that is due to the presence of the encapsulated helicoidal auxiliary spring.

The Applicant has therefore set himself the problem of how to make a constructionally simplified hinge in order to limit production costs and make assembly of the elements that constitute the hinge relatively easy. The Applicant also set himself the problem of how to make a particularly strong hinge.

The aforesaid objectives were achieved by the Applicant by means of a snap hinge for furniture.

The snap hinge for furniture according to the present invention comprises two articulated quadrilaterals driven elastically by at least two elastic means in which at least one of said elastic means consists of a double spiral flexure spring extending perpendicularly to the winding axis of the double spiral.

The features and advantages of the snap hinge for furniture according to the present invention will become clearer from the following description given by way of non-limiting example referring to the attached schematic drawings in which.

Figure 1:
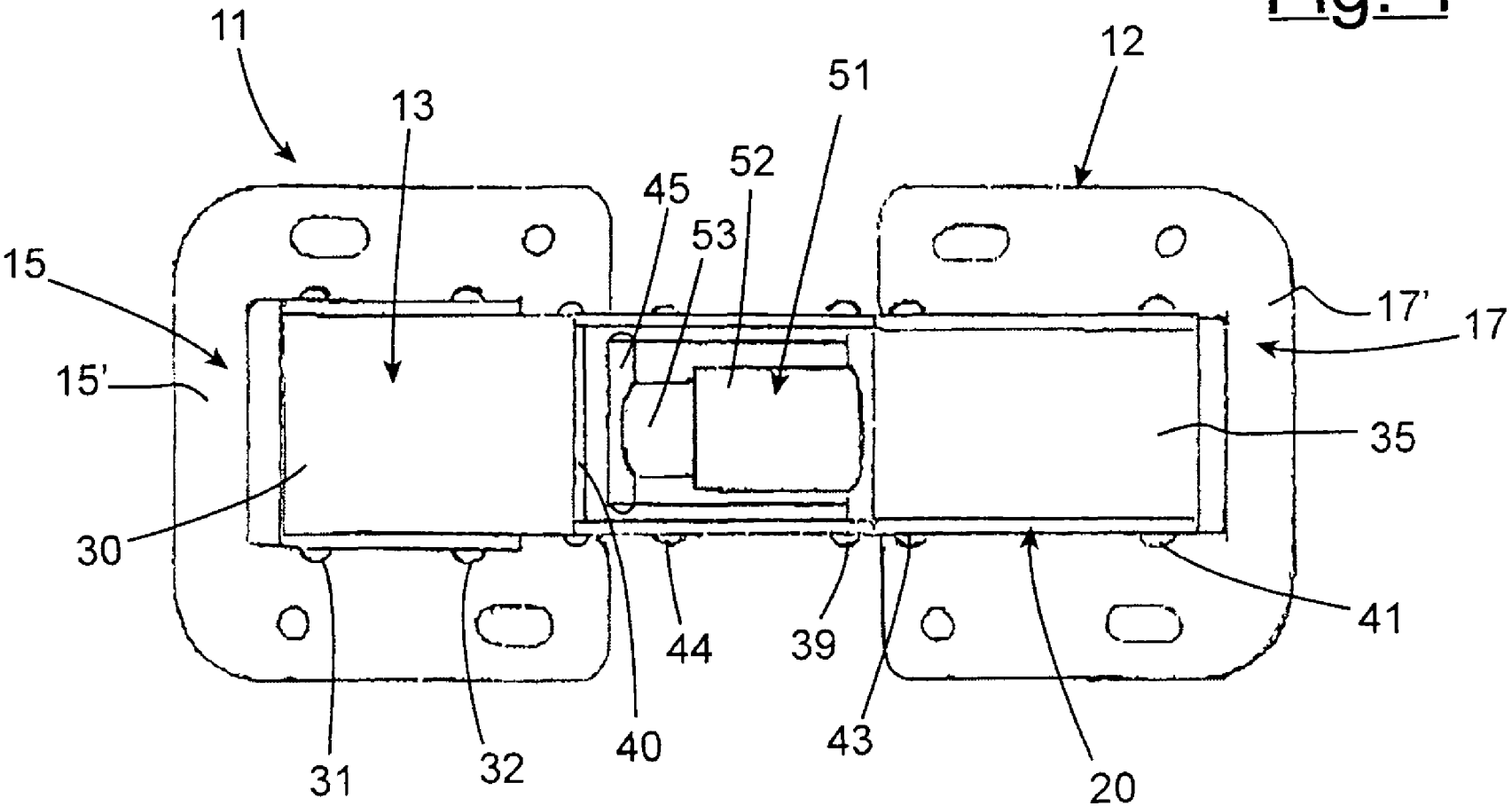
FIG. 1 is a top plan view of the hinge according to the invention in an open configuration.
Figure 2:
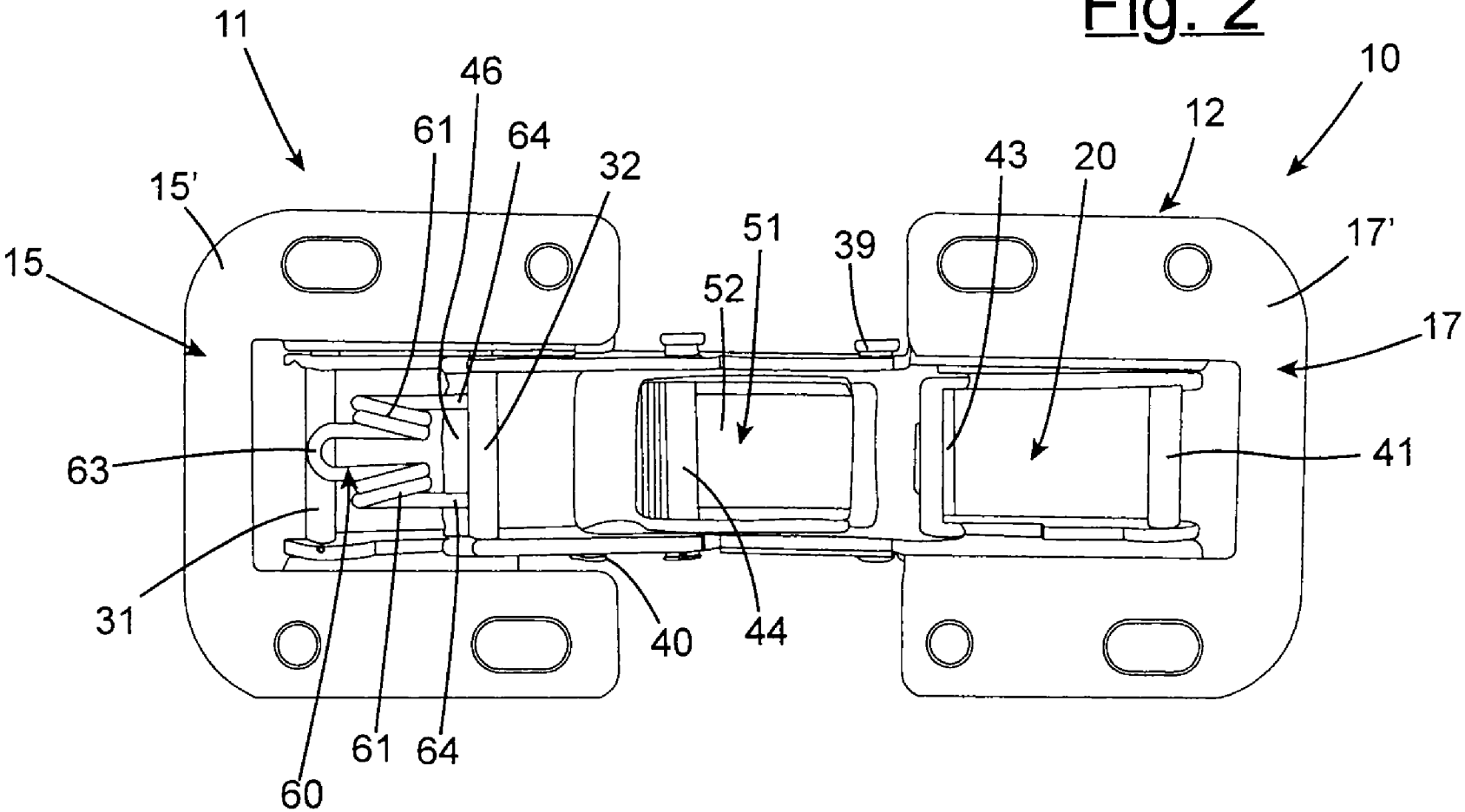
FIG. 2 is a bottom plan view of the hinge according to the invention in an open configuration.
Figure 3:
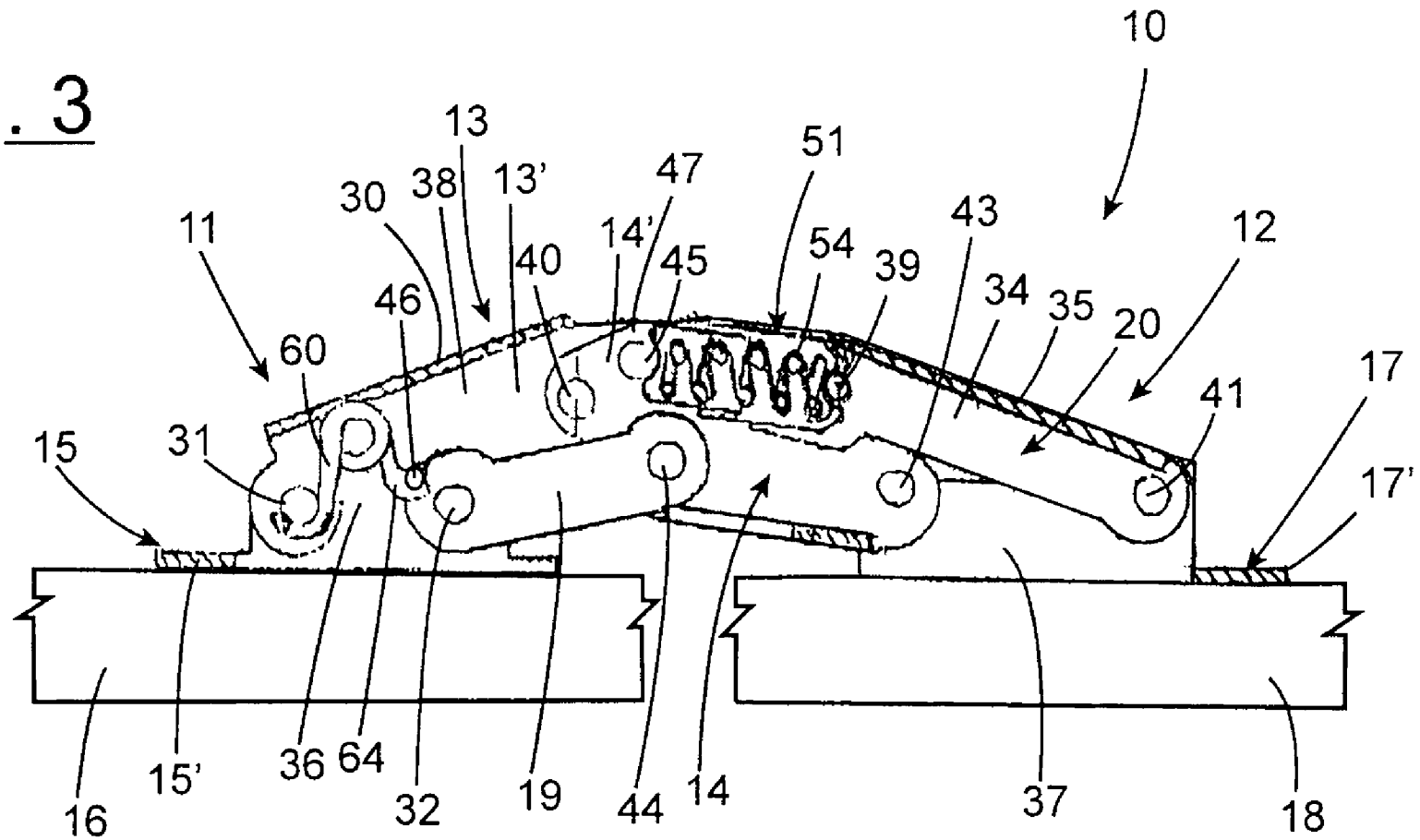
FIG. 3 is a lateral section view of the hinge according to the invention in an open configuration.
Figure 4:
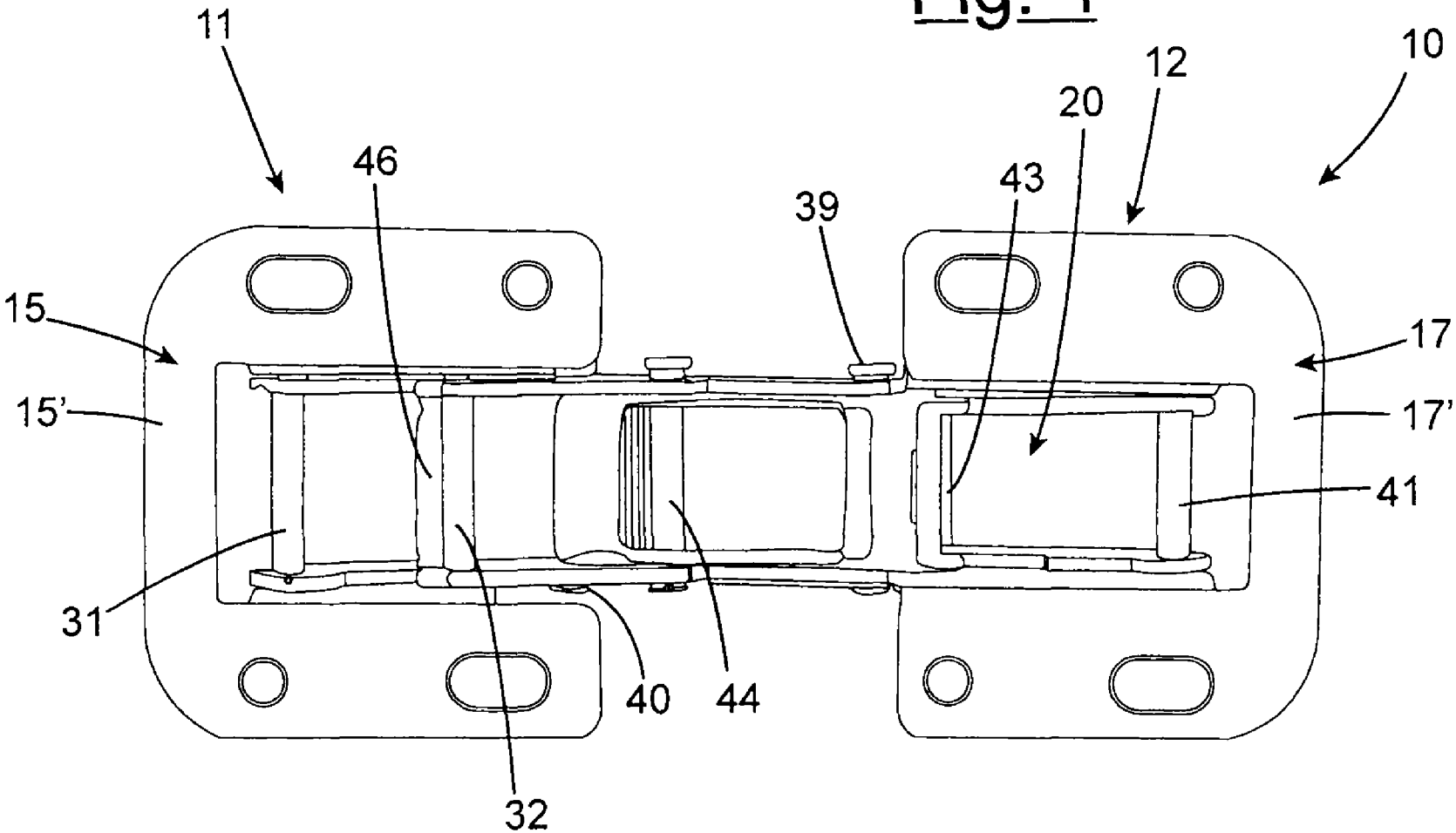
FIG. 4 is a bottom plan view of the hinge according to the invention in an open configuration, devoid of the elastic means.
Figure 5:
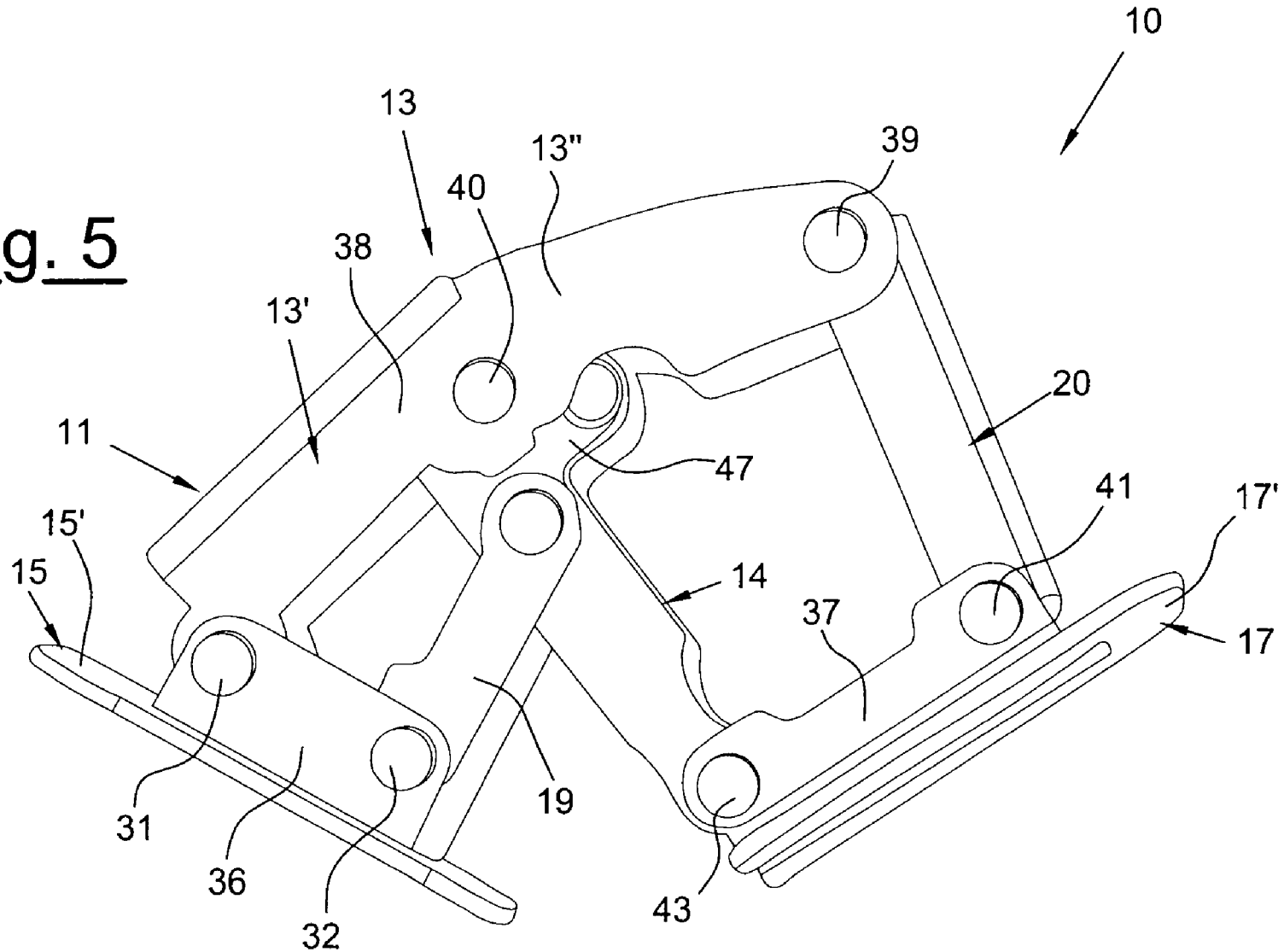
FIG. 5 is a lateral raised view of the hinge, according to the invention devoid of the elastic means and in a substantially closed configuration.

With reference to the figures, the snap hinge 10 for furniture, according to the present invention, comprises a first articulated quadrilateral 11 and a second articulated quadrilateral 12 that have in common amongst themselves a first lever 13 and a second lever 14 and have as a base element, respectively, a first fixing bracket 15, for fixing, for example, to a wall element 16 of a piece of furniture and a second fixing bracket 17 for fixing to a closing element 18 of the piece furniture.

The invention can be applied electively, if not exclusively, in the sectors of furniture for campers, caravans or the like.

With particular reference to a wall cabinet, the wall element 16 constitutes the upper part of the cabinet, the first fixing bracket 15 being anchored on the internal surface of this wall.

The closing element 18 is substantially a door and the fixing bracket 17 is arranged for being fixed by screws to the surface facing inside the cabinet when the door is in the closed position.

The first articulated quadrilateral 11 comprises, in articulation sequence, the first fixing bracket 15, a first portion 13' of the first lever 13, a first portion 14' of the second lever 14 and a first arm 19 that are articulated amongst themselves.

The second articulated quadrilateral 12 comprises, in an articulation sequence, the second fixing bracket 17, the second lever 14, a second portion 13" of the first lever 13 and a second arm 20 that are articulated amongst themselves.

For productive advantages, in order to minimise the number of operations and to simplify the operations, the elements are preferably produced by moulding from a web.

In general terms the levers and the arms constituting the articulated quadrilaterals are made so as to have "U"-shaped profiles with two sides joined by a back bridge, in this manner a double parallel articulation is achieved that makes the hinge more resistant.

The two fixing brackets 15 and 17 are quadrangular in shape, having a base portion, respectively 15' and 17' intended to be fixed to the furniture from which a pair of parallel flaps rises, respectively first flaps 36 from the first bracket 15 and second flaps 37 from the second bracket 17 that constitute a side of the corresponding articulated quadrilateral.

On the first pair of flaps 36 there is hinged by means of a first pin 31 an end of the first portion 13' of the first lever 13 that is also made with a profile that is partially U-shaped, being provided with two sides 38 joined by a back bridge 30 that extends along the entire first portion 13'.

A second pin 40 traverses in a median position said first lever 13 between the first and the second portion 13' and 13" to hinge the end of the first portion 14' of the second lever 14.

A third pin 44 is arranged at the end of the first portion 14' of the second lever 14 to hinge on the latter an end of the first arm 19.

The first quadrilateral 11 is closed with the opposite end of the first arm 19 hinged via a fourth pin 32 spaced away from the first pin 31, on the flaps 36.

The second quadrilateral is made, starting from the hinging by means of a fifth pin 43, of the second lever 14 on the second flaps 37 of the second bracket 17 that constitute the first side of the second quadrilateral.

The second lever 14 is completely exploited as a second side of the second quadrilateral until it is connected to the first lever 13, hinging in the second pin 40.

A third side of the quadrilateral consists of the second portion 13" of the first lever 13 that at the end is hinged on the second arm 20 by means of a sixth pin 39.

The second arm 20 is in turn provided with a back bridge 35 that joins the sides.

The last side of the second quadrilateral consists of the second arm 20 that closes on the second flaps 37, hinging by means of a seventh pin 41.

First and second elastic means 60 and 51, by means of a substantially serial arrangement, cooperate with the two articulated quadrilaterals 11 and 12 to open and support the door and to keep the door closed.

The first elastic means 60 are arranged in the first quadrilateral between the first pin 31 and a bridge abutment 46 made between the two sides of the first arm 19 near the end thereof hinged on the first flaps 36.

The second elastic means are engagingly arranged between said sixth pin 39 and an eighth pin 45 inserted into a protrusion 47 exiting the two sides of the second lever 14 between the second and the third pin respectively 40 and 44.

The second elastic means 51 comprise at least one helicoidal torsion spring 54 compressed along the relevant winding axis.

The spring 54 is enclosed within a capsule with telescopic caps coupled axially slidably in relation to one another and provided with shaped heads to adapt to the respective anchoring points on the second quadrilateral.

In particular, a first cap 52 is rotatably associated with the sixth pin 39 whilst a second cap 53 is rotatably associated with the eighth pin 45, to perform the elastic action of the second elastic means on the second quadrilateral.

The first elastic means 60 are made by means of a double spiral flexure spring 61 that is stressed perpendicularly to the winding axis of the double spiral.

The double spiral is connected centrally by a loop 63 that engages on the first pin 31. The ends 64 of the spring are on the other hand engaged on the bridge abutment 46 made between the two sides of the first arm 19.

The first spring 60 made in this way is particularly effective and strong and has reduced overall dimensions.

The invention claimed is:

1. A snap hinge for furniture, comprising:

a first articulated quadrilateral; and a second articulated quadrilateral, the first and second articulated quadrilateral having in common a first lever and a second lever, wherein said first and second articulated quadrilateral are driven elastically by at least two elastic means, wherein at least one of said elastic means comprises a double spiral flexure spring stressed perpendicularly to a winding axis of the double spiral, wherein said articulated quadrilaterals have as a base element, respectively, a first fixing bracket, for fixing to a wall element of a piece of furniture and a second fixing bracket fixed to a closing element of the piece of furniture, the first articulated quadrilateral including, in an articulation sequence, the first fixing bracket, a first portion of the first lever, a first portion of the second lever and a first arm that are articulated amongst themselves, wherein the second articulated quadrilateral includes, in an articulation sequence, the second fixing bracket, the second lever, a second portion of the first lever and a second arm that are articulated amongst themselves, wherein the levers and the arms constituting the articulated quadrilaterals are made so as to have "U"-shaped profiles with two sides joined by a bridge or back, so as to make a double parallel articulation that makes the hinge more resistant, wherein said first and second fixing brackets are quadrangular in shape, having a base portion respectively and intended to be fixed to the furniture, from which a pair of parallel flaps rise, respectively first flaps from the first bracket and second flaps from the second bracket that constitute a side of the corresponding articulated quadrilateral, wherein on the first pair of flaps by means of a first pin there is hinged an end of the first portion of the first lever that is made with a partially U-shaped profile provided with two sides joined by a back bridge that extends along an entire first portion, a second pin traverses in a median position said first lever between the first and the second portion to hinge the end of the first portion of the second lever, a third pin is arranged at the end of the first portion of the second lever to hinge on the latter an end of the first arm, the first quadrilateral closes with the opposite end of the first arm hinged by means of a fourth pin, spaced apart from the first pin, on the flaps, wherein the second quadrilateral is made, starting from the hinge, via a fifth pin, of the second lever to the second flaps of the second bracket that constitute the first side of the second quadrilateral, the second lever is completely exploited as the second side of the second quadrilateral until it is connected to the first lever hinging in the second pin, a third side of the quadrilateral consists of the second portion of the first lever that at its end is hinged on the second arm via a sixth pin, the second arm being in turn provided with a back bridge that joins the sides thereof, the last side of the second quadrilateral consists of the second arm that closes on the second flaps hinging via a seventh pin, wherein a first of said elastic means are made via a double spiral flexure spring connected centrally via a loop that engages on the first pin, the ends of the spring being engaged on a bridge abutment made between the two sides of the first arm.

2. The snap hinge according to claim 1, wherein a second of said elastic means is engagingly arranged between said sixth pin and an eighth pin inserted into a protrusion projecting from two sides of the second lever between the second pin and the third pin, said second elastic means comprise at least a helicoidal torsion spring enclosed within a capsule with telescopic caps that are axially coupled slidably with one to another and are provided with shaped heads to adapt to respective anchoring points on the second quadrilateral.

3. The snap hinge according to claim 2, wherein said capsule with telescopic caps includes a first cap that is rotatably associated with the sixth pin whilst a second cap is rotatably associated with the eighth pin, to perform the elastic action of the second elastic means on the second quadrilateral.

* * * * *